US006520720B1

(12) United States Patent
Boldurev

(10) Patent No.: US 6,520,720 B1
(45) Date of Patent: Feb. 18, 2003

(54) ARTIFICIAL ISLAND, ARTIFICIAL ISLAND SUPPORT AND METHOD FOR BUILDING AN ARTIFICIAL ISLAND

(76) Inventor: Vladimir Sandzhievich Boldurev, 8 mikroraion, 4, kv.15, Elista 358014 (RU)

( * ) Notice: Subject to any disclaimer, the term of this patent is extended or adjusted under 35 U.S.C. 154(b) by 0 days.

(21) Appl. No.: 09/831,811

(22) PCT Filed: Aug. 16, 2000

(86) PCT No.: PCT/RU00/00333

§ 371 (c)(1),
(2), (4) Date: May 14, 2001

(87) PCT Pub. No.: WO01/88278

PCT Pub. Date: Nov. 22, 2001

(30) Foreign Application Priority Data

May 15, 2000 (RU) ..... 2000111846

(51) Int. Cl.[7] ..... E02B 17/00
(52) U.S. Cl. ..... 405/195.1; 405/228
(58) Field of Search ..... 405/211, 217, 405/222, 224, 227, 228, 195.1, 210; 114/264, 265, 258

(56) References Cited

U.S. PATENT DOCUMENTS

| | | | | | |
|---|---|---|---|---|---|
| 2,043,452 | A | | 6/1936 | Strauss | |
| 3,779,024 | A | * | 12/1973 | Greve | 405/210 |
| 4,186,532 | A | * | 2/1980 | Kahn | 405/189 |
| 4,583,882 | A | | 4/1986 | Szabo | |
| 4,648,749 | A | * | 3/1987 | Ferguson | 405/211 |
| 4,648,752 | A | * | 3/1987 | Guy et al. | 405/217 |
| 4,699,545 | A | * | 10/1987 | Chen et al. | 405/217 |
| 4,799,828 | A | * | 1/1989 | Georgii | 405/195.1 |
| 4,828,431 | A | * | 5/1989 | Chen | 405/217 |
| 4,963,058 | A | * | 10/1990 | Broughton et al. | 405/211 |
| 4,984,935 | A | * | 1/1991 | de Oliveira Filho et al. | 405/211 |
| 5,088,858 | A | * | 2/1992 | Massoudi | 405/222 |
| 5,125,769 | A | * | 6/1992 | Lee et al. | 114/264 |
| 5,292,207 | A | * | 3/1994 | Scott | 405/211 |

FOREIGN PATENT DOCUMENTS

| | | | |
|---|---|---|---|
| DE | 30 37 030 | A1 | 4/1982 |
| FR | 2609704 | | 12/1987 |
| GB | 2 205 883 | A | 12/1988 |
| JP | 404070422 | * | 3/1992 |
| JP | 323432 | * | 11/2001 |
| RU | 2059424 | C1 | 9/1996 |
| RU | 2064553 | C1 | 2/1997 |
| RU | 2107773 | | 8/1998 |

* cited by examiner

*Primary Examiner*—Frederick L. Lagman
(74) *Attorney, Agent, or Firm*—Lackenbach Siegel, LLP

(57) ABSTRACT

The proposed artificial island is made in the style of a landscape of mountain volcanic islands covered with natural growth, for arranging in it the oil/gas producing and refining equipment, with simultaneously restoring the sea biologic resources, is intended for creating a closed producing/refining complex having a social infrastructure, and providing for complete processing of industrial and domestic waste. At the place for building the artificial island, a leveling of sea bottom is performed, a support is installed in the form of support piles (5) and outlining envelope. The latter is made yielding the internal bay by installing main pontoons which are coupled by means of a banking ring. Floating piles (6) are driven down opposite to the main pontoons along the external perimeter of the banking ring and fixed to the said pontoons. The support piles are driven down to hard carrier rocks (13) of the sea bottom along the internal perimeter of the banking ring, excluding places intended for navigable canals which can be blocked. Then, the step of forming at least one navigable canal which can be blocked, is performed for coupling the internal bay with an open sea. And a dome is built on the support piles above the internal bay for arranging an oil/gas producing (21) and refining (22) equipment, as well as a power-generating unit (23), production areas (24) and living rooms (25).

59 Claims, 13 Drawing Sheets

Figure 1:
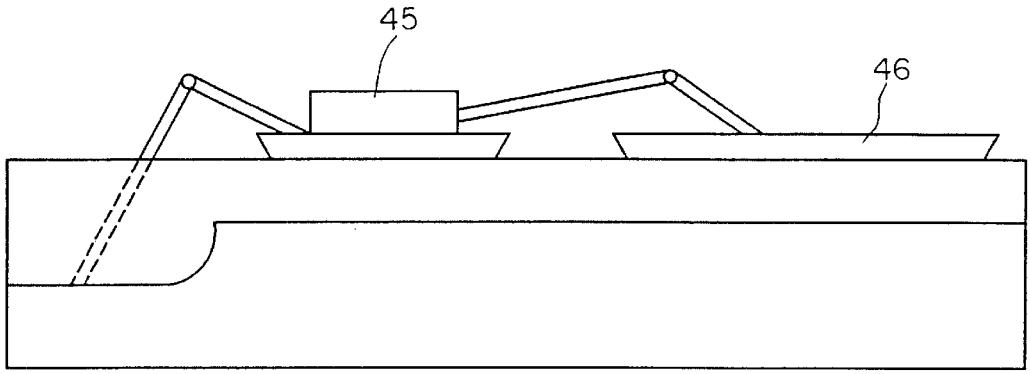

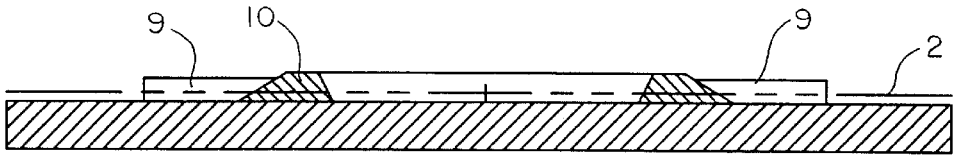
FIG. 5
FIG. 6
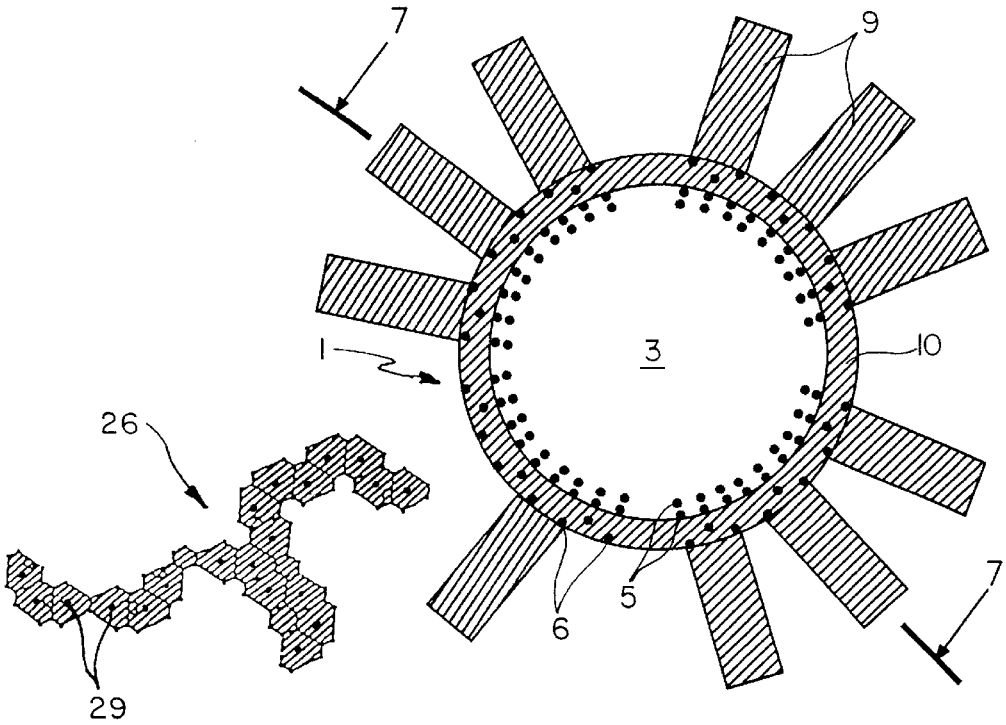

ARTIFICIAL ISLAND, ARTIFICIAL ISLAND SUPPORT AND METHOD FOR BUILDING AN ARTIFICIAL ISLAND

The invention relates to hydraulic building and is intended for developing and arranging a sea shelf for producing and perfectly refining a hydrocarbon feedstock, which are combined with a total utilization of industrial and domestic waste, restoration of sea biologic resources including a landscape and environment enhancement and arrangement of the social and industrial infrastructure.

An artificial island comprising a support installed on a sea bottom, which support is erected from separate blocks by filling separate sections of form with earth is known (U.S. Pat. No. 2,043,452, U.S.Cl. 405-222, Jun. 6, 1936). This artificial island has a very limited usage as a breakwater element.

An artificial island is known (U.S. Pat. No. 4,583,882, Int.Cl. E 02 D 21/00, Apr. 22, 1986) having a support which is erected by injecting a gelforming fluid into sea water from a moving vessel in order to form a gel mass from the sea surface to the sea bottom, a trajectory of the vessel being selected so as the gel mass forms a required support configuration. This method requires a great consumption of gelatinizing agent for raising even a small-size artificial island, the produced support serving only for enclosing the interior of the artificial island from sea waves and ice, since the strength of the support made of the gel mass is not sufficient to raise great buildings on it.

An artificial island comprising a support is known from the RU patent No 2107773 (Int.Cl. E 02 D 17/00, Mar. 27, 1998).

An artificial island support is known from the same RU patent No 2107773, comprising an outlining envelope installed onto the sea bottom and rising above the sea level, and support piles.

A method for building an artificial island on a sea shelf is known from the same RU patent N2 2107773, said method including steps of installing an outlining envelope rising about the sea level, and driving down supporting piles.

These subjects are chosen as the nearest analogues for subject matters of this application.

A drawback of all three indicated subjects is an impossibility to avoid an environmental pollution in the case of a failure ejection of the hydrocarbon feedstock produced by equipment installed on such island. This is caused by a small size of the artificial island, which size, in its turn, is defined by a support size not allowing to raise the separating constructions on that support, much less any equipment besides the drilling or producing one; hence, the produced hydrocarbon feedstock needs to be transported in tankers, the ejection of the hydrocarbon feedstock to the environment is possible as well when charging those tankers, e.g., ejection into an open sea, especially in rough sea.

The task to be solved by the present invention is to increase the ecological safety in developing and arranging a sea shelf for producing and perfectly refining a hydrocarbon feedstock, which are combined with a total utilization of industrial and domestic waste, by means of reducing the detrimental material ejection; to enhance the ecological environment of peoples in accordance with the international standards, to enhance the peoples' inhabitation conditions in ecologically unfavorable regions, as well as to rehabilitate pollution territories.

This task is solved by means of an artificial island, comprising a support rising above the sea level, according to the invention, the said artificial island is provided with a dome, and the support is made in the form of a ring yielding an internal bay which is coupled with an open sea by at least one navigable canal made with an ability to block that canal, and the dome is mounted on the support above the internal bay. Along with this, in particular cases of making the artificial island its dome forms a grotto above the internal bay made in the form of a tower, which is made stepped conical or cylindrical, the upper part of the tower is made of glass, the internal grotto space in the tower is made with at least one level that, in its turn, is made with the central hole, and the said internal grotto space is intended for placing a drilling equipment, and/or an oil/gas producing equipment, and/or an oil/gas refining equipment, and/or a power-generating unit; production areas and/or living rooms are placed in the tower along its side-generating line; the artificial island is provided with gates of the stop log type for blocking the navigable canals; the artificial island is made according to a type of the landscape of a mountain volcanic island covered with vegetation; the artificial island is provided with at least one peripheral artificial island formation made either in the form of pontoons, which are installed in the form of beams diverging from the center of the artificial island, and floating piles, the peripheral artificial island formation being fixed in its node points to said floating piles, or in the form of partitions from main pontoons having canals, additional pontoons being installed along the external perimeter of the banking ring, and the partitions are installed in the form of beams diverging from the additional pontoons and coupled by canals with the internal bay for passing ships from said internal bay to an open sea, partition sides facing away from said pontoons are blocked by stop log type gates and coupled by means of the limiting barrier consisting of a chain of additional pontoons and banked with earth at the exterior, sectors limited by the external perimeter of the banking ring, by the partitions at each side, and by the limiting barrier at the exterior, are forming water areas, and the small artificial islands are made of an irregular form from the additional pontoons and hydraulically deposited earth and erected in said water areas; the additional pontoons are made in a hexagonal form from ferroconcrete; the peripheral artificial island formations are intended for building a sea dendropark consisting of basin technological complexes for industrial reproduction of marine flora and fauna, and sports, tourist and recreation complexes.

This task is also solved by means of an artificial island support comprising an outlining envelope installed onto the sea bottom and rising above the sea level, and support piles, according to the invention, the artificial island support is provided with floating piles, the outlining envelope is made with an ability to form an internal bay from main pontoons disposed along the ring in the form of diverging beams, sides of those main pontoons facing the internal bay are coupled by means of a banking ring, the support piles are driven down along the internal perimeter of the banking ring to hard carrier rocks of the sea bottom, and the floating piles are driven down along the external perimeter of the banking ring and coupled with their corresponding main pontoons. Along with this, in particular cases of making the artificial island support its outlining envelope is made with at least one navigable canal and with ability to block said canal from an open sea by means of the gates of the stop log type; the main pontoons are made in a rectangular form from ferroconcrete with internal compartments for filling them with an earth excavated during a sea bottom leveling; the banking ring is made of earth hydraulically deposited concentrically from the internal border of said ring to its external border, the earth height exceeding the top level of the main pontoons, the banking ring, excluding places intended for the navigable canals, is strengthened at the exterior with large-fragmental rocks delivered from continental deposits and is strengthened at the interior with a support wall made of ferroconcrete plates.

This task is also solved by means of a method for building an artificial island on a sea shelf, said method including steps of installing an outlining envelope rising above the sea level, and driving down supporting piles, according to the invention, a step of leveling the sea bottom in the position of the artificial island building is performed, the outlining envelope is made yielding an internal bay by means of installing main pontoons disposed along the ring in the form of diverging beams, sides of said pontoons facing the internal bay are coupled by means of a banking ring, along which external perimeter opposite to the main pontoons floating piles are driven down and fixed to said pontoons, the supporting piles are driven down to hard carrier rocks of the sea bottom along the internal perimeter of the banking ring excluding positions intended for navigable canals with the blocking ability, then a step of forming at least one navigable canal with the blocking ability for coupling the internal bay with an open sea is performed, and thereafter a step of erecting a dome on the support piles above the internal bay is performed. Along with this, in particular cases of making the method, the main pontoons are made in a rectangular form from ferroconcrete and with internal compartments, said main pontoons are transported by water to an installation place, and then sunk by filling their internal compartments with an earth excavated earlier during the step of leveling the sea bottom; the banking ring is made by depositing hydraulically an earth concentrically from the internal border of said ring to its external border with a height exceeding the top level of the main pontoons; the banking ring, excluding places intended for the navigable canals, is strengthened at the exterior with large-fragmental rocks delivered from continental deposits and is strengthened at the interior with a support wall made of ferroconcrete plates; after the step of installing the outlining envelope, at least one peripheral artificial island formation is made at the exterior of said outlining envelope, said peripheral artificial island formation is intended for building a sea dendropark consisting of basin technological complexes for industrial reproduction of marine flora and fauna, and sports, tourist and recreation complexes, the peripheral artificial island formation is made either in the form of additional pontoons installed in the form of separate beams diverging from the artificial island center, and the peripheral artificial island formation is fixed in its node points to additional floating piles, or in the form of additional pontoons, partitions with canals, limiting barrier, stop log type gates and small artificial islands, along with this the additional pontoons are installed along the external perimeter of the banking ring, the partitions are made of the main pontoons, installed in the form of beams diverging from the additional pontoons, and coupled by canals with the internal bay for passing ships from said internal bay to an open sea; partition sides facing away from said additional pontoons are blocked by stop log type gates and coupled by means of the limiting barrier made of a chain of additional pontoons and banked with earth at the exterior, in the sectors limited by the external perimeter of the banking ring, by the partitions at each side, and by the limiting barrier at the exterior, forming water areas, the small artificial islands are made in an irregular form from the additional pontoons and hydraulically deposited earth in those water areas, the additional pontoons are made in a hexagonal form from ferroconcrete; the dome above the internal bay is built for creating a grotto and said dome is made in the form of a stepped conical or cylindrical tower built with a technique of casting continuously the concrete or with a technique of arranging the large-sized prefabricated elements fixed to the structure carrier framework collected from carrier columns, the upper part of the tower is made of glass; after building the dome, the stop log type gate is installed in the navigable canal for blocking that canal, a drilling equipment is installed in the internal bay on a floating support, said bay is blocked from an open sea, and at least one borehole is drilled, the drilled boreholes are preserved, the drilling equipment is dismounted and removed from the internal bay along the navigable canal, in the tower, levels are made in the internal grotto space, yielding three levels for placing an equipment and, oil/gas producing equipment and reservoirs are mounted on the first level, an oil/gas refining equipment is mounted on the second level, and a power-generating unit is mounted on the third level, living rooms are placed along the tower side generating line on the second and third levels, and production areas are placed along the tower side generating line on the first level; after mounting the equipment, a layout of the power network from the power-generating unit, and a layout of the water pipe-line and waste-water conduit are performed; the artificial island is made according to a type of a landscape of a mountain volcanic island covered with vegetation, and the produced raw material and/or products of its refining are sent using corresponding ships via the navigable canals.

Figure 2:
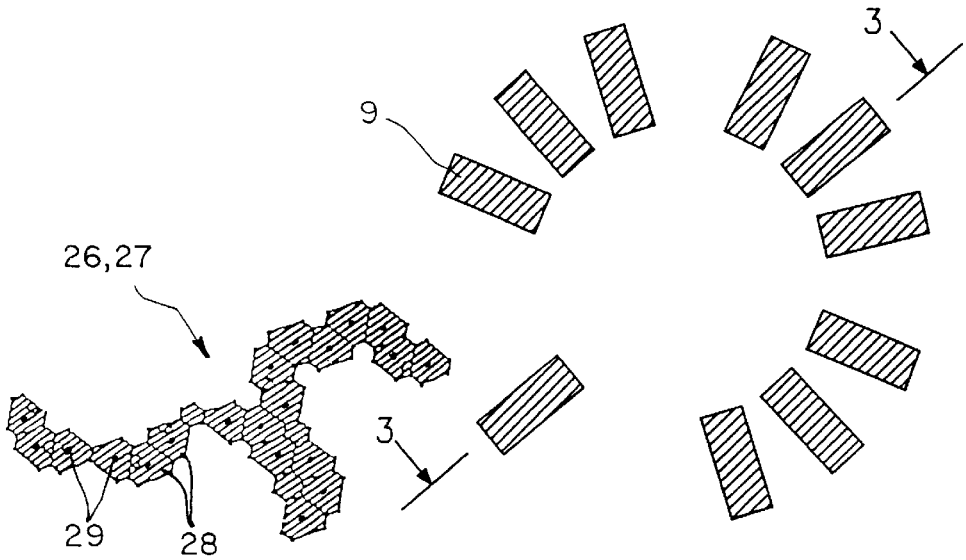
Figure 3:
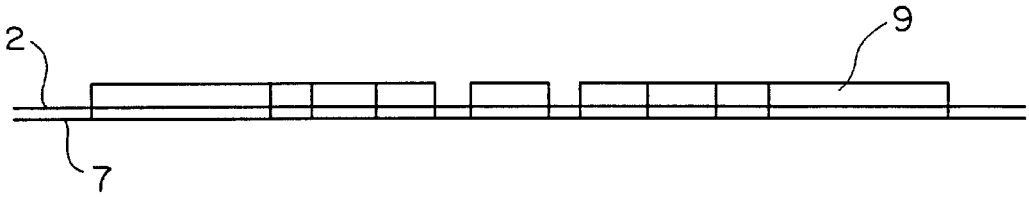
Figure 4:
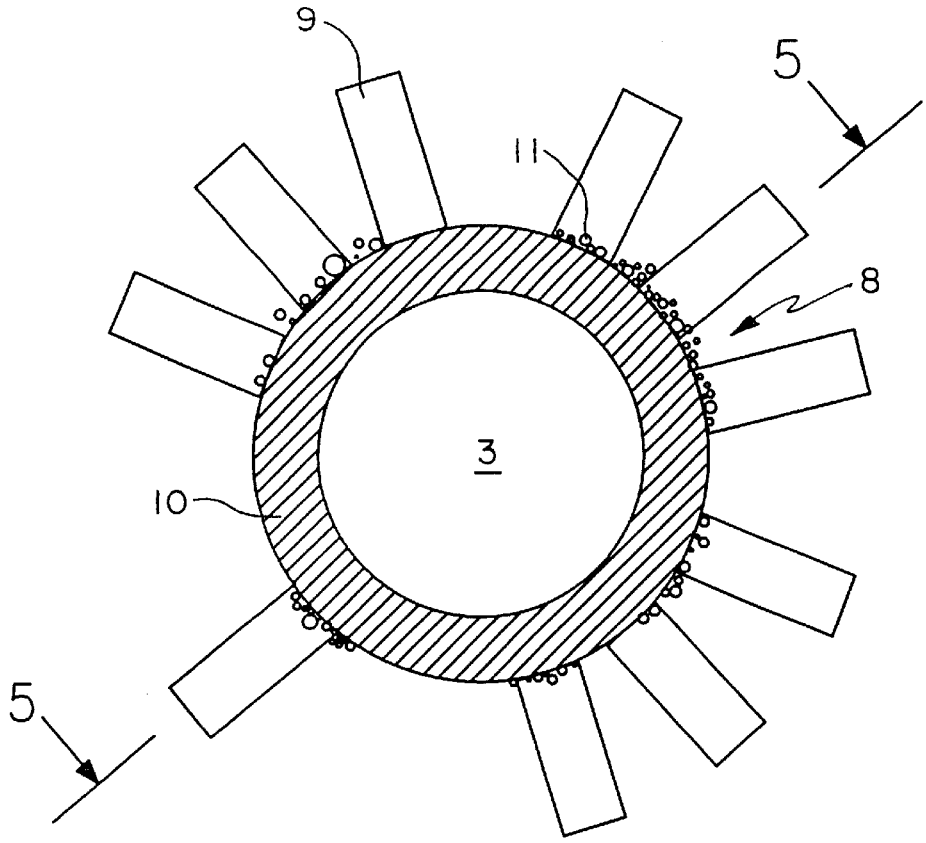
Figure 7:
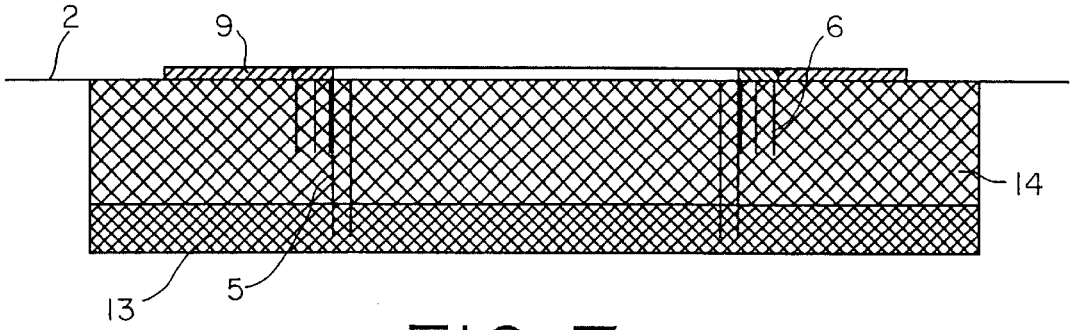
Figure 10:
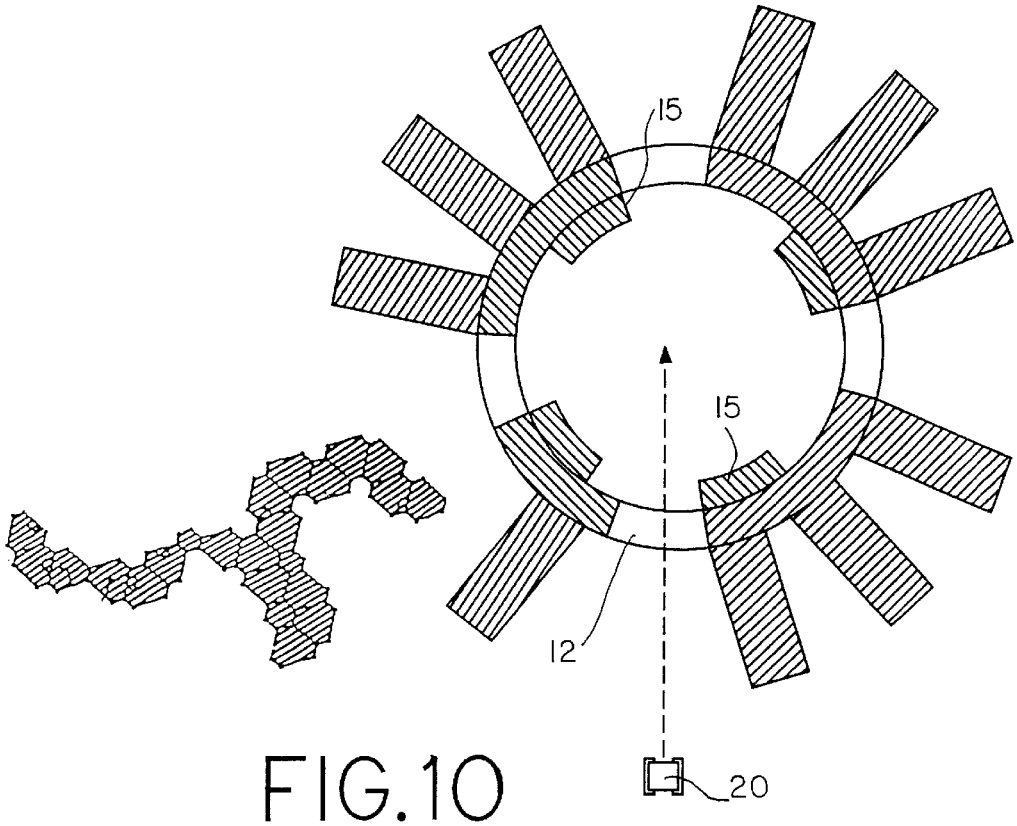
Figure 8:
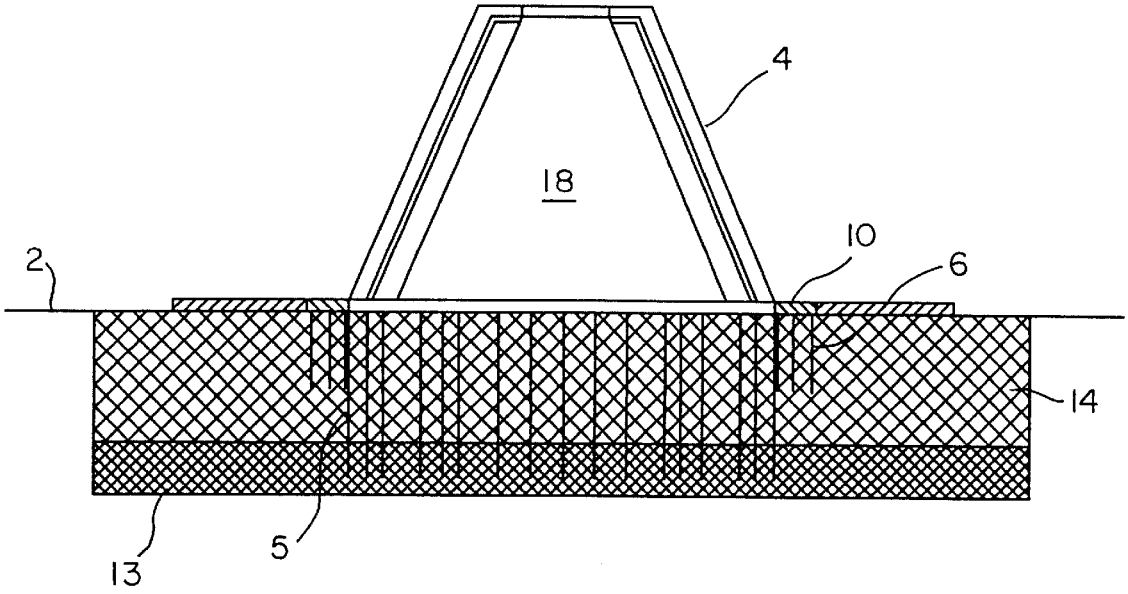
Figure 9:
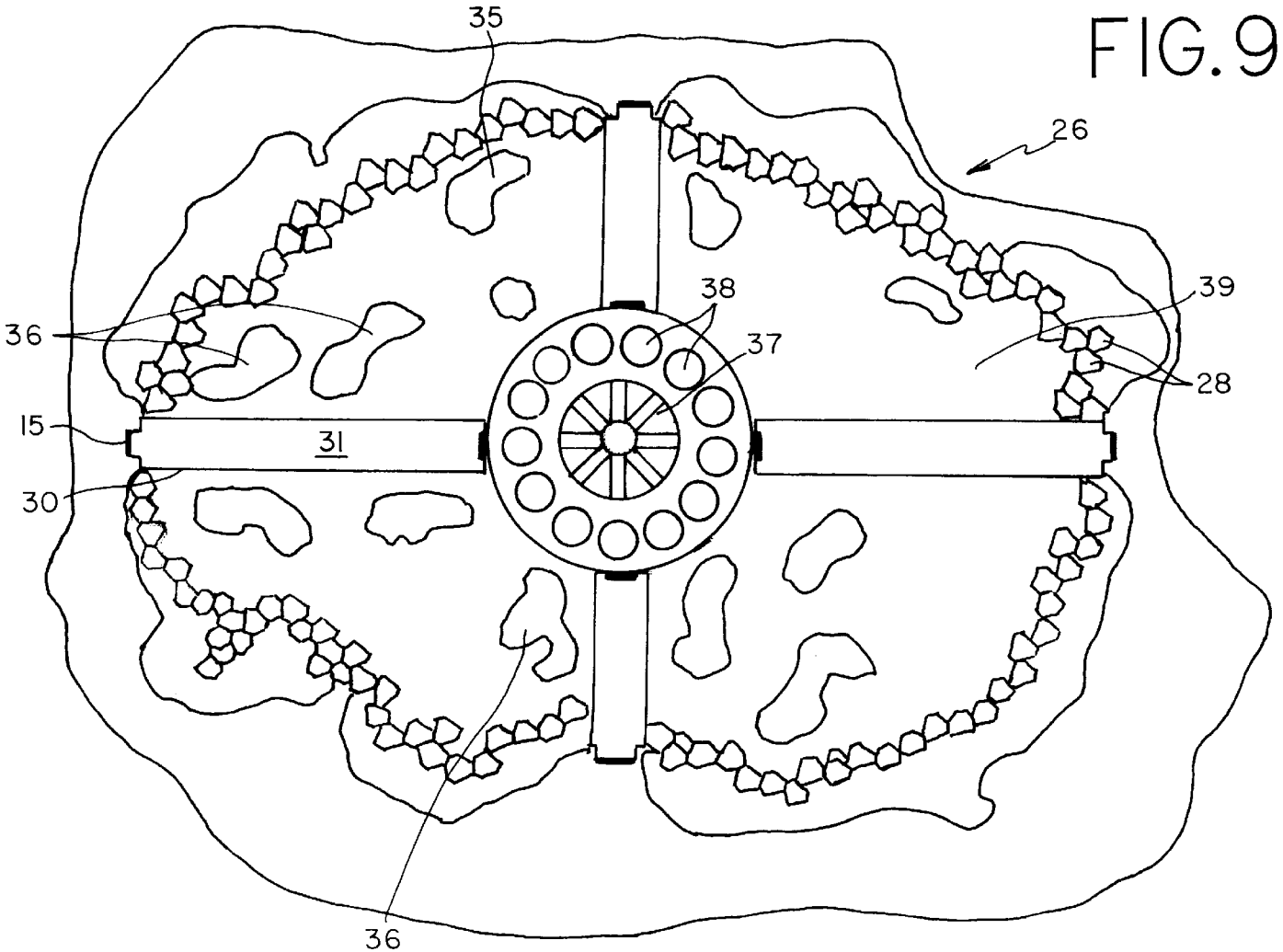
Figure 11:
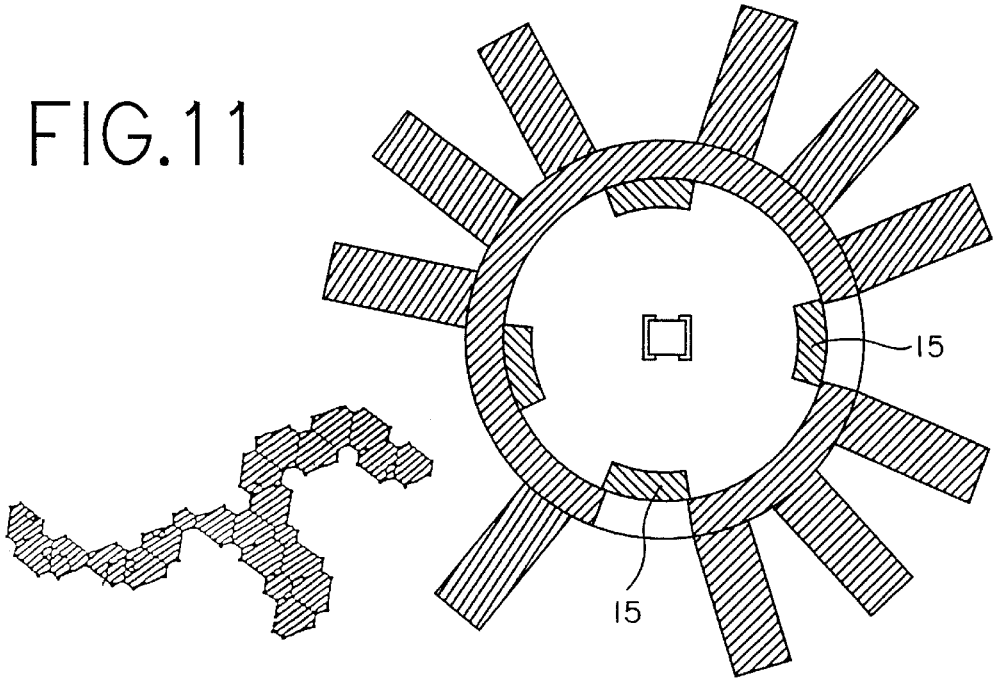
Figure 15:
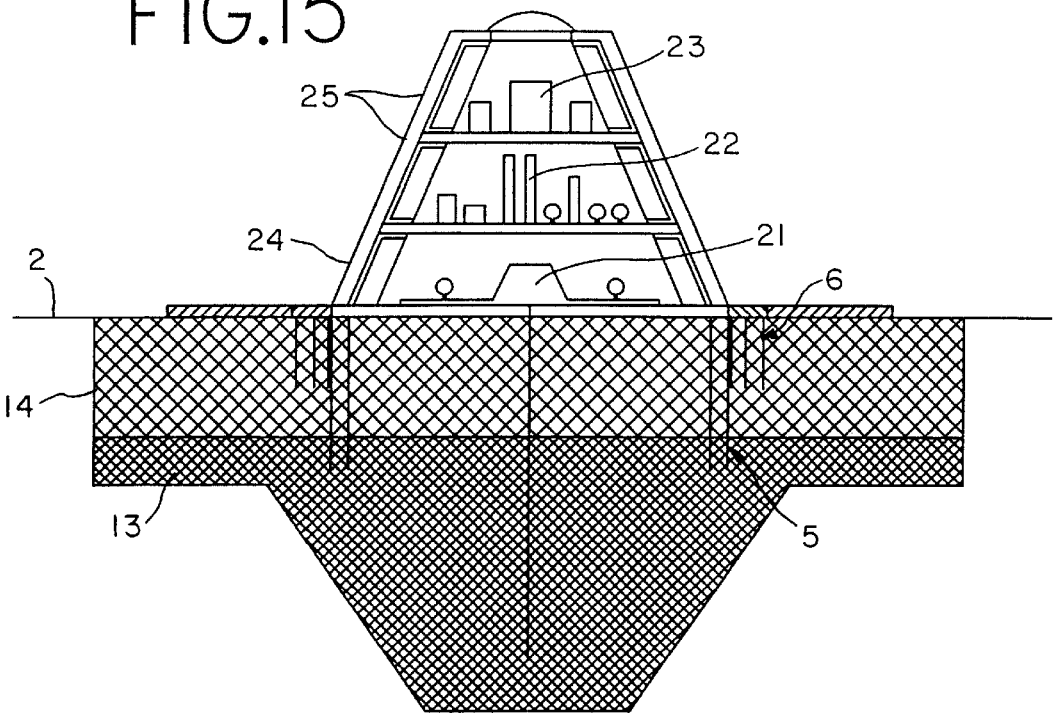
Figure 12:
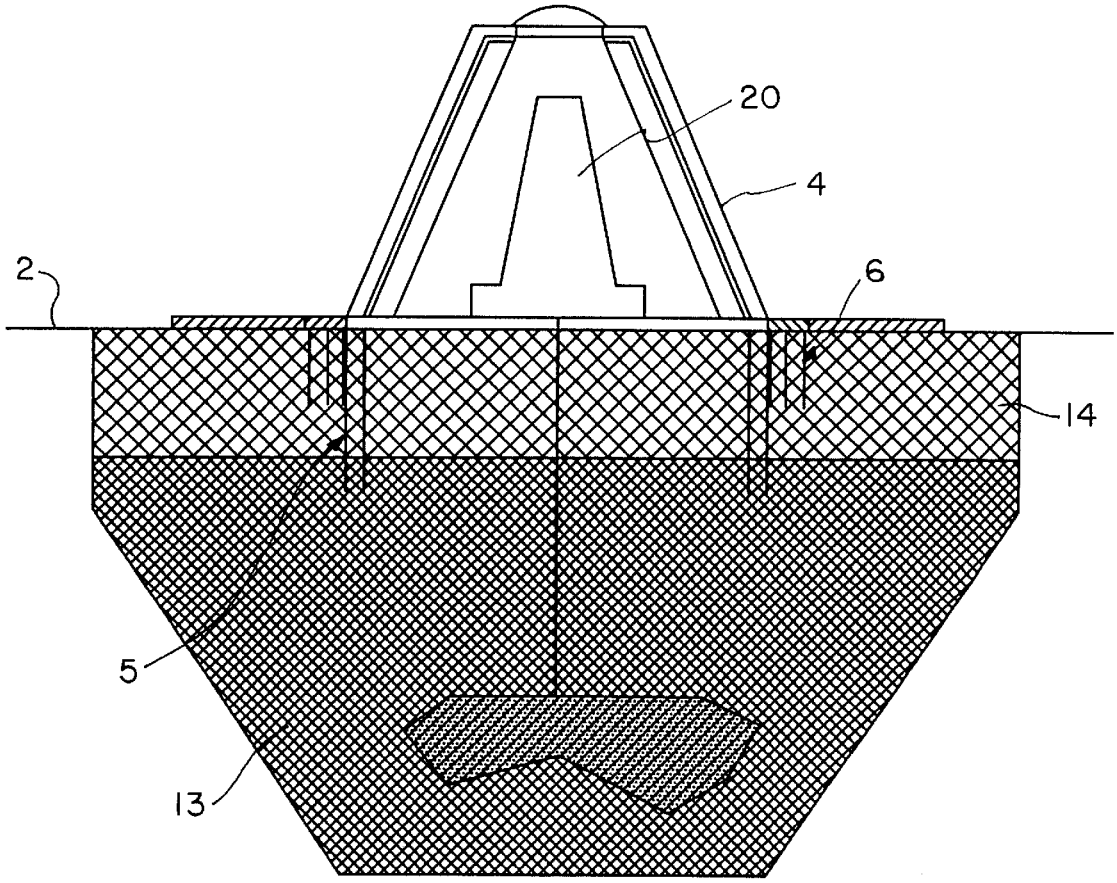
Figure 13:
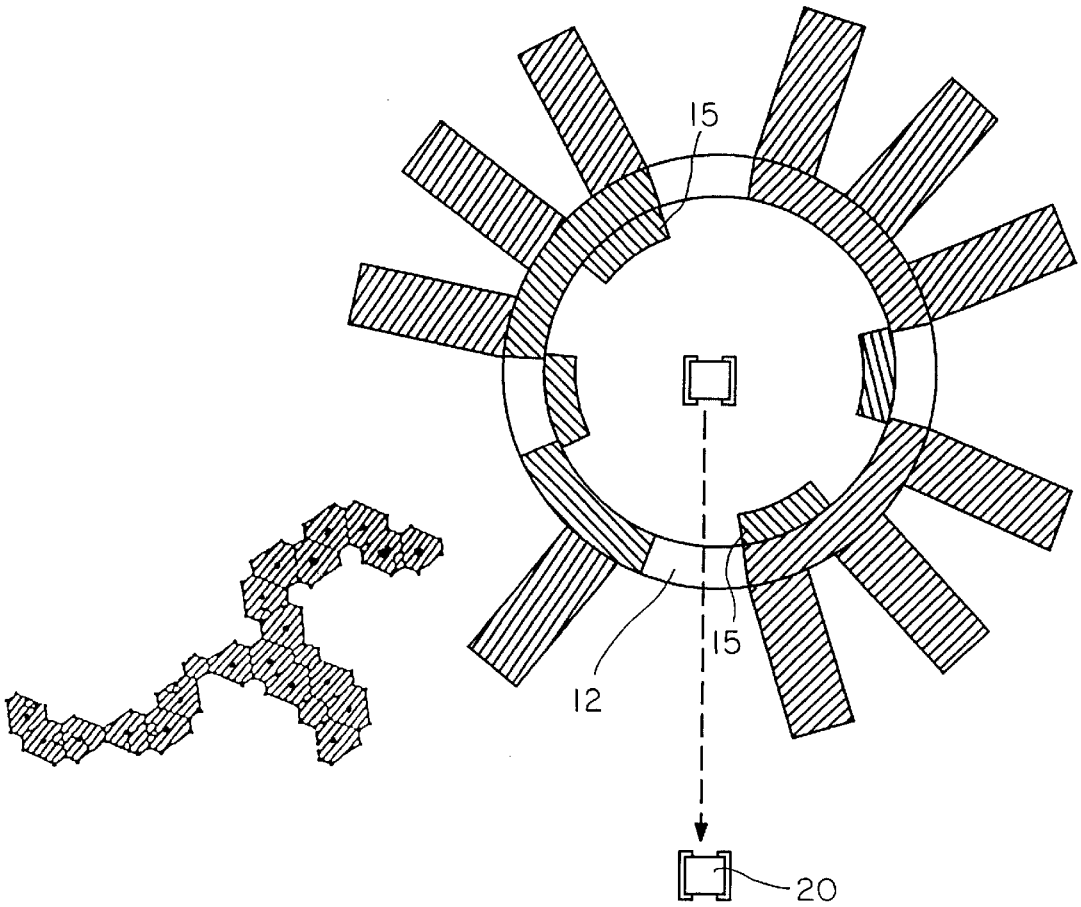
Figure 14:
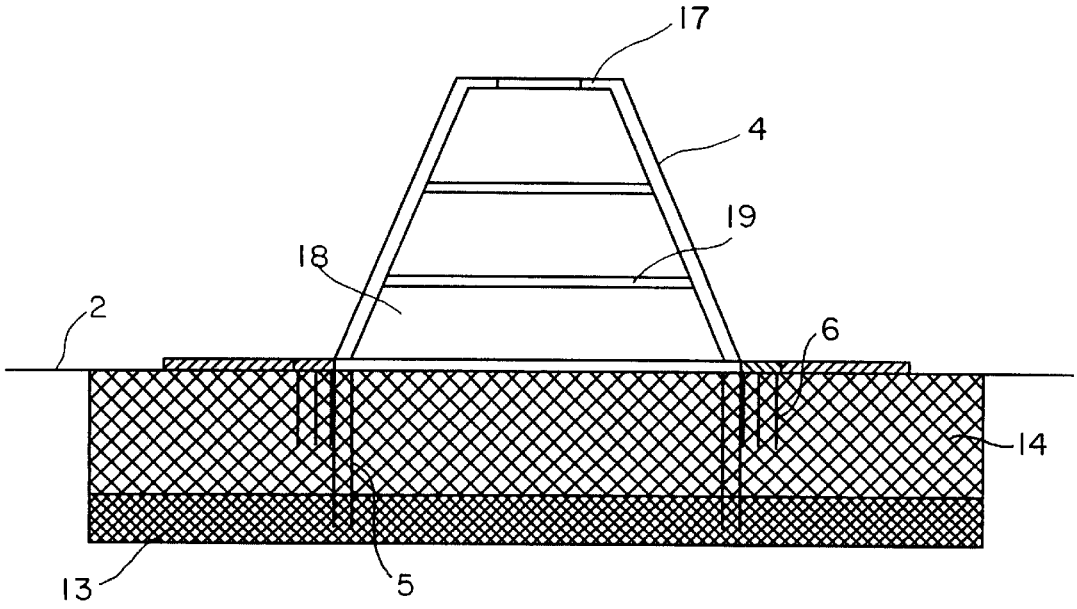
Figure 16:
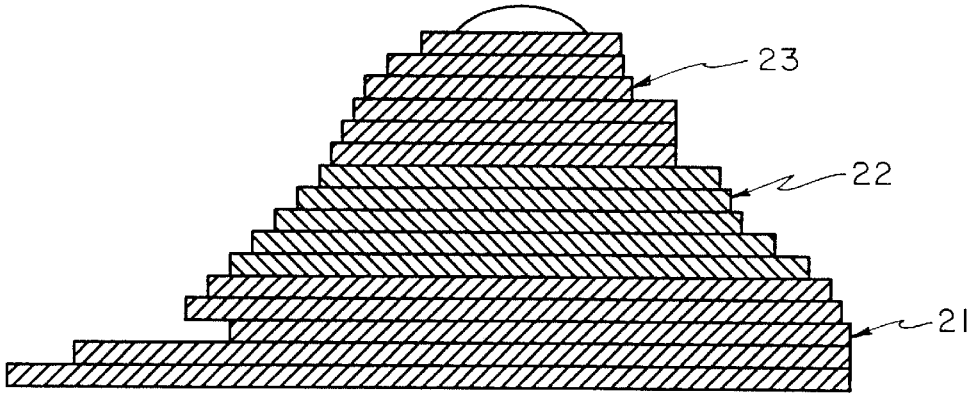
Figure 17:
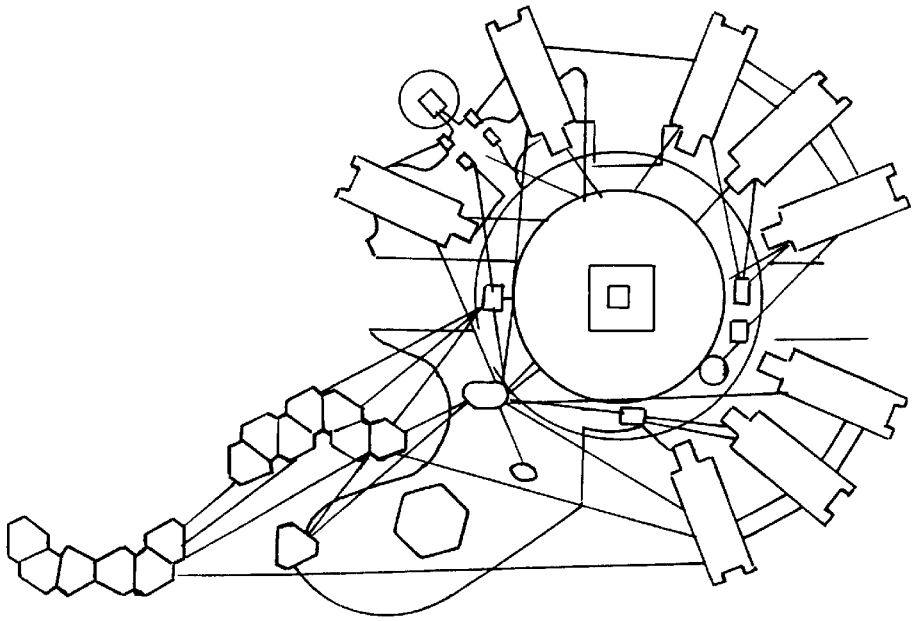
Figure 18:
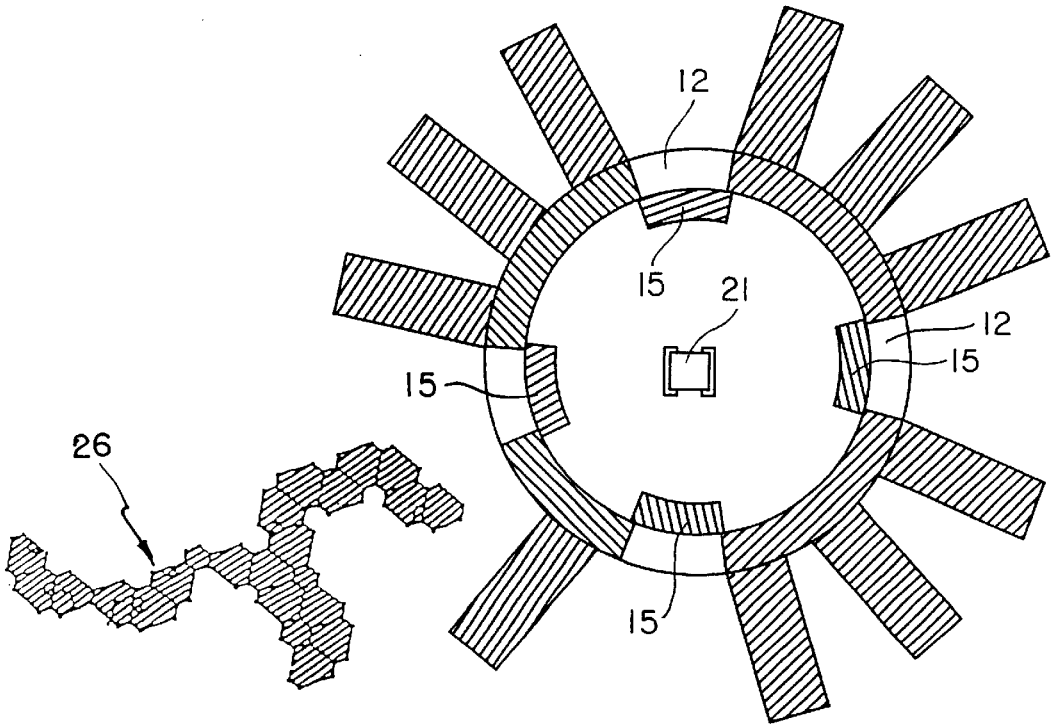
Figure 19:
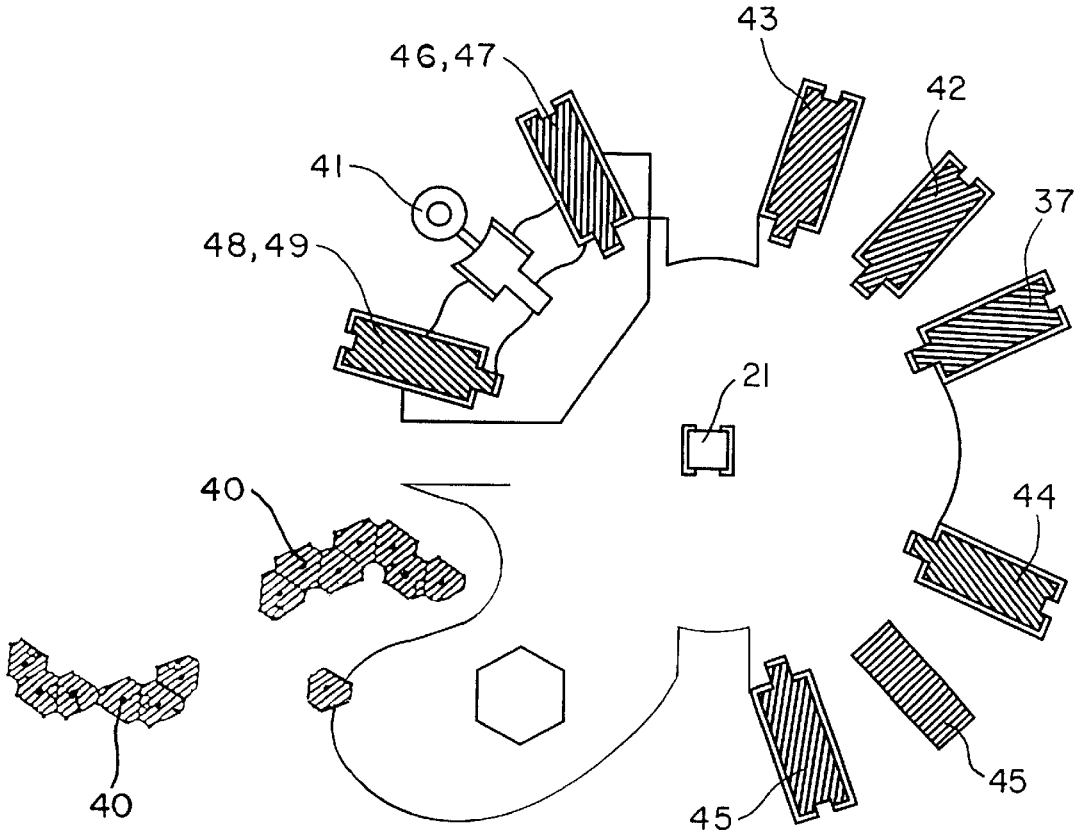

The essence of the invention is illustrated by drawings, where the stage-by-stage building of the artificial island is depicted, namely: FIG. 1 shows a stage I (hydraulic operations for leveling the sea bottom at the place of the artificial island building); FIG. 2 shows a stage II (installing the main pontoons circumferentially in the form of diverging beams); FIG. 3 is a cross-section A—A in FIG. 2; FIG. 4 shows a stage III (implementing the banking ring); FIG. 5 is a cross-section B—B in FIG. 4; FIG. 6 shows a stage IV (driving down the supporting and floating piles); FIG. 7 is a cross-section C—C in FIG. 6; FIG. 8 shows a stage V (implementing the dome); FIG. 9 shows a stage VI (forming the sea dendropark consisting of basin technological complexes for industrial reproduction of marine flora and fauna); FIG. 10 shows a stage VII (installing the drilling equipment on the floating support in the center of the internal bay); FIG. 11 shows the same stage VII (blocking the internal bay from an open sea with the gates of stop log type); FIG. 12 shows a stage VIII (carrying out the drilling operations); FIG. 13 shows a stage IX (dismantling the drilling equipment); FIG. 14 shows a stage X (spanning the internal grotto cavity and yielding three levels); FIG. 15 shows a stage XI (mounting the oil/gas production equipment on the first level, the oil/gas refining equipment on the second level and the power-generating unit on the third level, living rooms along the tower side generating line on the second and third levels, and production areas along the tower side generating line on the first level); FIG. 16 is a diagram of functional zoning of the stepped conical tower; FIG. 17 shows a stage XII (performing the layout of the power network from the power-generating unit, and the layout of the water pipe-line and waste-water conduit); FIG. 18 shows a stage XIII (blocking the internal bay from an open sea with the gates of stop log type); FIG. 19 shows a stage XIV (building the production, administrative-economic, consumer-service, sports, tourist and recreation complexes).

The artificial island comprises the support 1 made in the form of a ring rising above the sea level 2 and yielding the internal bay 3. On the support 1 the dome 4 is mounted which forms a grotto 30 m in height above the internal bay 3. The ring of the support 1 is made in the form of support piles 5, floating piles 6 and outlining envelope 8 installed on the sea bottom 7 and rising above the sea level 2. In so doing, the envelope 8 forms the internal bay 3 and is made of the main pontoons 9 disposed circumferentially in the form of diverged beams, the main pontoons sides facing the internal bay are coupled with a banking ring 10. The main pontoons are made of ferroconcrete and have rectangular shape of 30×12×3 m or more with internal compartments for filling them with an earth excavated during sea bottom leveling. The banking ring 10 is made of earth hydraulically deposited concentrically from the internal border of said ring to its external border, the earth height exceeding the top level of the main pontoons 9, and strengthened at the exterior with large-fragmental rocks 11 delivered from continental deposits, and at the interior with a support wall made of ferroconcrete plates. The support piles 5 are driven down to hard carrier rocks 13 of the sea bottom along the internal perimeter of the banking ring 10 excluding positions intended for navigable canals 12. The floating piles 6 are driven down along the external perimeter of the banking ring 10 into the soft sea bottom basis 14, and coupled with their corresponding main pontoons 9. In the outlining envelope 8 are made four navigable canals 12 with an ability to block those canals by means of gates 15 of the stop log type. The dome 4 is made in the form of a stepped conical 16 or cylindrical tower which is coupled with the floating piles 6. The upper part 17 of the tower is made of glass. In the tower, the internal grotto space 18 is made with floors 19 forming three levels and intended for placing drilling equipment 20, oil/gas producing equipment 21, oil/gas refining equipment 22, and a power-generating unit 23. Said floors 19 are made with the central hole for moving cargo in mounting and dismantling the equipment using lifting-and-conveying machinery. In the tower along its generating line are placed production areas 24 and/or living rooms 25. The artificial island is made according to a type of the landscape of a mountain volcanic island covered with vegetation. From the external side of the outlining envelope 10, the peripheral artificial island formations 26 are made, which can be built, for example, in the form of separate beams 27 diverging from the artificial island center and formed from additional hexagonal ferroconcrete pontoons 28 having the size of about 9.5×11×3 m, which are fixed in the node points of the peripheral artificial island formation 26 to additional floating piles 29 driven down into the soft sea bottom basis 14. Another embodiment of the peripheral artificial island formation 26 is as follows: additional pontoons 28 made with banking are installed along the external perimeter of the banking ring 10; partitions 30 made of the main ferroconcrete pontoons 9 and having canals 31 coupled with the internal bay 3 for passing ships from said internal bay to an open sea diverge from additional pontoons 28 in the form of beams up to 5,000 m in length; external ends of the partitions 30 are coupled by means of the limiting barrier 32 made of a chain of additional pontoons 28 banked with earth 33 at the exterior; four sectors 34 limited by the external perimeter of the banking ring made of the additional pontoons 28, by the partitions 30 at each side, and by the limiting barrier 32 at the exterior, form water areas, where the small artificial islands 35 of an irregular form are erected from the additional pontoons 28 and hydraulically deposited earth; partition ends from exterior of said diverging beams are blocked by stop log type gates 15. In this case, the additional pontoons 28 employed in building said peripheral artificial island formations are made of ferroconcrete in a hexagonal form. Other embodiments of the peripheral artificial island formation 26 are possible too. These peripheral artificial island formations 26 are intended for building a sea dendropark consisting of basin technological complexes for industrial reproduction of marine flora and fauna (lotus plantations 36, fish-farming nursery-station 37, nurse-ponds 38 for rearing young fish, places 39 for sports (fishing etc.), tourist complexes 40, production complexes (e.g., transport complex 41, caviar plant 42, fish cannery 43, knitted-goods factory 44, polyethylene and polyethylene articles producing plants 45, etc.), housing unit 46, consumer-service unit 47, administrative-economic unit 48, as well as a telecommunication complex 49, nature-preservation, bank, health-protection, landscape complexes, etc.

The artificial island is built by the following method in several stages.

Stage I

Hydraulic Operations for Leveling the Sea Bottom at the Place of the Artificial Island Building Just after finishing the geologic-engineering research for industrial building sites and developing an overall plan and foundation plan on the basis of this research, the hydraulic operations are performed for leveling the sea bottom 7 at the place of the artificial island building. The first stage includes:

a) leveling of-the sea bottom 7 to the depth of 1.5 m to install the main pontoons 9 there, as well as the additional pontoons 28 being the main carrier elements of the artificial island foundation;

b) leveling of the sea bottom 7 from four sides for the navigable canals 12 leading to the internal bay 3 of the artificial island, the leveling depth being defined by a draught of the metal floating pontoons transporting the drilling equipment 20 to the internal bay;

c) leveling of the sea bottom 7 for the water area of the internal bay 3, the levelling depth being defined by a draught of the floating objects brought to the internal bay 3.

The leveling is carried out by utilizing dredgers 50 and cargo barges 51 used for transporting the excavated earth. Further, the excavated earth is utilized for banking the support elements of the built artificial island.

Stage II

Installation of the Main Pontoons Circumferentially in the Form of Diverging Beams Within the frames of the second stage, the main pontoons 9 and additional pontoons 28 are tugged by waterway to the place of installation. The tugging is carried out in weather conditions corresponding to operating parameters of each pontoon type. Depending on the power of a tugboat, the tugging of pontoons is carried out piece-by-piece or in a caravan order. Each pontoon is pushed to the place of the immediate installation by the pushboat. The main pontoons 9 are arranged in the form of beams diverging from the common center. In this case, the common center is the water area of the internal bay 3. Once the main pontoons 9 are arranged in a predetermined configuration, their final installation to the earth is performed by filling the internal compartments with the earth excavated earlier in the stage I during the leveling of the sea bottom 7.

Stage III

Implementation of the Banking Ring

Sides of the main pontoons 9 facing the internal bay 3 are coupled by means of the banking ring 10 produced by hydraulic deposition of the earth concentrically from the internal border of said ring to its external, periphery border. The height of the banking ring 10 exceeds the top level of the main pontoons 9. Once the hydraulic deposition of the external side of the banking ring 10 is finished, this external side is strengthened with large-fragmental rocks 11 delivered from continental deposits by barges 46 discharged using a bucket. Places of the external border of the banking ring 10 intended for removing in future and opening the passages of the navigable canals 12 leading to the internal bay 3 are not strengthened with the large-fragmental rocks 11. The internal border of the banking ring 10 is strengthened with a support wall made of ferroconcrete plates. In the support wall the breaks are left for passages of the navigable canals 12.

Stage IV

Driving Down of the Support and Floating Piles

The floating piles 6 are driven down to the soft base 14 of the sea bottom 7 along the internal perimeter of the banking ring 10 opposite to the main pontoons 9 and fixed to the corresponding main pontoons 9 in order to ensure a sharp fixation of the predetermined configuration in the arrangement of the main pontoons 9. Then, the peripheral artificial island formation 26 is built, which is made of the additional pontoons 28 installed in the form of beams 27 diverging from the artificial island center, the peripheral artificial island formation is fixed in its node points to the additional floating piles 29 driven down to the soft base 14 of the sea bottom in order to ensure a sharp fixation of the configuration of the peripheral artificial island formation 26. The peripheral artificial island formation 26 can be also made in the form of additional pontoons 28, partitions 30 with canals 31, limiting barrier 32, stop log type gates 15, and small artificial islands 35, the additional pontoons 28 being installed along the external perimeter of the banking ring 10, the partitions being made of the main pontoons 9, installed in the form of beams diverging from the additional pontoons, and coupled by canals 31 with the internal bay 3 for passing ships from said internal bay to an open sea; partition sides facing away from said additional pontoons 28 are blocked by stop log type gates 15 and coupled by means of the limiting barrier 32 made of a chain of additional pontoons 28 and banked with earth 33 at the exterior; sectors 34 limited by the external perimeter of the banking ring 10, by the partitions 30 at each side, and by the limiting barrier 32 at the exterior, forming water areas, and the small artificial island 35 being made in an irregular form from the additional pontoons 28 and hydraulically deposited earth in those water areas. Along the internal perimeter of the banking ring, excluding positions intended for navigable canals, the support piles 5 are driven down, which are driven down, contrary to the floating piles 6, to the moment of contact with hard carrier rocks 13 of the sea bottom and serve as the support elements of the dome 4. Then, an excavation of the earth at the parts of the banking ring 10 is carried out for forming the navigable canals 12 leading to the internal bay 3. As a result, the navigable canals 12 become available to pilotage.

Stage V

Implementation of the Dome

The floating building machinery is transported to the water area of the internal bay 3, as well as the building equipment, building elements, structures and materials, which are temporary placed and stored on the surface of the main pontoons 10 and additional pontoons 28 installed stationary at the previous stages. Then, by means of the floating mobile false-work, using a technique of casting continuously the concrete with embedding the reinforcements, the dome 4 is erected as a monolith. The dome 4 can be erected as well by the technique of configuring the large-sized prefabricated elements fixed to the building carrier frame which is composed from carrier columns. In this case, the assembling is performed using the cargo heavy helicopter aviation, and thus, the time of assembling decreases sharply, but this technique leads to inevitable substantial growth of expenses. The dome 4 being built is generally a stepped conical hollow tower 16 which is 30 m high and has a grotto and a hole in its upper part, which is covered with glass later on. The strength of the ferroconcrete structures forming the dome 4 is sufficient for long-term resistance to the external and internal point impact loads.

Stage VI

Formation of the Sea Dendropark Consisting of Basin Technological Complexes for Industrial Reproduction of Marine Flora and Fauna In the center of the sea dendropark being built, on the foundation of the additional pontoons 28 is erected a fish-farming nursery-station 37 being a semi-sphere structure surrounded with plastic nurse-ponds 38 for rearing young fish, which are round in form and joined closely along the external generating line of that structure. Then, partitions 30 with canals 31 are mounted and built up in length (up to 5,000 m) in the form of diverging beams beginning from the internal banking of the fish-farming nursery-station 37. The partitions are mounted from the main pontoons 9. At the external ends of the partitions 30 on the side opposite to the fish-farming nursery-station 37, the gates 15 of the stop log type are installed for isolation from an open sea. A system of seines with an automatic drive are placed on the bottom bed. The water area of the partitions 30 is intended for young fish, and is the main element of the fish recovery complex production line, which element ensures both the manufacture of fish products and a sea biologic resource replenishment by means of setting young fish free into an open sea. Then, the external ends of the partitions 30 are coupled by means of the limiting barrier 32 made of a chain of additional pontoons 28 and banked with earth 33 at the exterior. Artificial islands 35 spread in a chaotic manner and intended for planting lotus and creating conditions for sports-fishing are built in the water areas of four formed sectors 34. Thus, work are performed in the VI stage frame to form the sea dendropark the distinctive feature of which is to combine into a common unit:

a) basin technological complexes for industrial reproduction of sturgeon and other breeds of fish;

b) the fish-farming nursery-station;

c) nurse-ponds for rearing young fish;

d) places for the sports-fishing of a small island type, etc.

Stage VII

Installation of the Drilling Equipment on the Floating Support in the Center of the Internal Bay and Blocking of the Internal Bay from an Open Sea with the Stop Log Gates The stage VII begins in parallel with the stage VI. The navigable canals 12, in the places of their intersection with the banking ring 10, are equipped with gates 15 of the stop log type made of steel structures having autonomous drives and ensuring a complete hermetic sealing of the internal bay 3 in the case of their closing. The drilling equipment 20 is piloted along the navigable canal 12, being disposed on steel floating pontoons in a vertical or horizontal position, and then the drilling equipment is positioned in the internal bay 3. After that, the internal bay 3 is sealed hermetically by closing the gates 15 of the stop log type.

Stage VIII

Drilling Operations

The drilling operations are carried out by the drilling equipment 20 of the chosen type till passing underground seams and coming to an oil field lens.

Stage IX

Dismantling of the Drilling Equipment

The borehole is laid up temporarily, the drilling equipment 20 is dismantled, after that the stop log type gate 15 of the navigable canal 12 is opened, and the drilling equipment 20 disposed on the steel floating pontoons is removed to an open sea.

Stage X

Spanning of the Internal Grotto Cavity and Yielding of Three Levels

In the internal bay 3 and around the central hole in the upper part 17 of the tower disposed is a hoisting machinery, by means of which a spanning of the internal grotto space 18 is performed later on with ferroconcrete floors 19, forming three levels. In the central part of the ferroconcrete floors 19 through-holes are provided for moving cargo during mounting and dismantling equipment using the hoisting machinery installed near those holes.

Stage XI

Mounting of the Oil/gas Production and Refining Equipment, Reservoirs, Power-generating Unit, and Also Living Rooms and Production Areas First, the tower upper part 17 covering the grotto from above is glazed. Then, the power-generating unit 23 is disposed on the third level, the oil/gas refining equipment 22 is disposed on the second level, and the oil/gas producing equipment 21 is disposed on the first level, moreover, the living rooms 25 are disposed along the tower side generating line on the second and third levels, and the production areas 24 are disposed along the tower side generating line on the first level. The oil/gas producing equipment 21 is disposed on a steel floating platform with extending jacks, which platform enters into the internal bay 3 via the navigable canal 12 with the open stop log type gate 15, whereupon the platform is positioned and jacks are extended, so that the platform is supported on these jacks above the water level. Other implementations of the platform for the oil/gas producing equipment are possible.

Stage XII

Layout of Communications

This stage begins during works of the stage XI, after finishing the mounting of the power-generating unit 23 on the third level. At this stage, parallel works are carried out for laying out the power network from the power-generating unit, the water pipe-line and waste-water conduit, along with installing transformer substations, main distribution switchboard, switchboards of distribution, waste-water and water pump stations, gate valves, etc. It should be noted that potable water is taken via artesian wells from water fields disposed in the region of the industrial producing complex, and waste fluid fractions are pumped down into oil-bearing layers for supporting an internal layer pressure, whereby ensuring full autonomy and closed-circuit circulation of water and fluid fractions of industrial and domestic waste. The power and sewer networks are coupled into a single closed-circuit self-sufficient autonomous complex by combining both the structures disposed in the grotto part of the island and the structures disposed on peripheral artificial island formations.

Stage XIII

Blocking of the Internal Bay from an Open Sea with the Gates of Stop Log Type

The stage XIII is superposed partially in the time with the stage XII. The stop log type gates 15 are closed after ceasing the supply of bulky components for completing power networks, water and waste-water conduits in the region of the artificial island grotto, thereby isolating the internal bay 3 from the external environment.

Stage XIV

Building and Putting into Operation of Auxiliary Complexes

At this stage, the living, hotel-tourist, industrial, administrative, bank complexes, etc., disposed at peripheral artificial island formations 26 and in the tower are put into operation.

Such implementation of the artificial island, its supports and the method for its building during developing and arranging the shallow sea shelf will allow to combine steps of producing and perfectly refining a hydrocarbon feedstock, with a total utilization of industrial and domestic waste, to restore sea biologic resources including a landscape and environment improvement, psychological and medico-biological rehabilitation of the staff, and arrangement of the social and industrial infrastructure. The invention has an important social and economic significance for making healthier the environment in areas affected by environmental crisis, especially protected territories and sea water areas, including oil-gas fields at the shallow shelf of the Caspian Sea. The proposed artificial island can be used for creating a chain of artificial island type installations implemented in a style of landscape of mountain volcanic islands covered with natural growth, for placing there oil/gas producing and refining industries with simultaneously restoring sea biological resources, for creating a closed industrial-producing complex with a social infrastructure providing the total processing of industrial and domestic waste with their full utilization by means of pumping down waste fluid fractions underground to maintain an internal layer pressure, and using waste solid fractions as a filler in producing ferroconcrete articles for further extending the territory of raised artificial building.

What is claimed is:

1. An artificial island, comprising a support rising above the sea level, characterized in that said artificial island is provided with a dome, the support being made in the form of a ring yielding an internal bay which is coupled with an open sea by at least one navigable canal capable of being blocked, and the dome being mounted on the support above the internal bay.

2. The artificial island according to claim 1, characterized in that the dome forms a grotto above the internal bay.

3. The artificial island according to claim 1, characterized in that the dome is made in the form of a tower.

4. The artificial island according to claim 3, characterized in that the tower is made stepped conical.

5. The artificial island according to claim 3, characterized in that the tower is made cylindrical.

6. The artificial island according to claim 3, characterized in that the upper part of the tower is made of glass.

7. The artificial island according to claim 3, characterized in that the tower is made with levels in an internal grotto space yielding three levels for placing equipment.

8. The artificial island according to claim 7, characterized in that the levels of the internal grotto space are made with a central hole.

9. The artificial island according to claim 2, characterized in that the internal grotto space is intended for placing drilling equipment, and/or oil/gas producing equipment, and/or oil/gas refining equipment, and/or a power-generating unit.

10. The artificial island according to claim 3, characterized in that production areas and/or living rooms are placed in the tower along its side generating line.

11. The artificial island according to claim 1, characterized in that said artificial island is provided with gates for blocking the navigable canals.

12. The artificial island according to claim 11, characterized in that the gates of navigable canals are of the stop log type.

13. The artificial island according to claim 1, characterized in that said artificial island is made according to a type of the landscape of a mountain volcanic island covered with vegetation.

14. The artificial island according to claim 1, characterized in that said artificial island is provided with at least one peripheral artificial island formation.

15. The artificial island according to claim 14, characterized in that the peripheral artificial island formation is made in the form of pontoons which are installed in the form of beams diverging from the center of the artificial island.

16. The artificial island according to claim 15, characterized in that said artificial island is provided with buoyant floating piles, the peripheral artificial island formation being fixed in its node points to said floating piles.

17. The artificial island according to claim 14, characterized in that the peripheral artificial island formation is made in the form of partitions from main pontoons having canals, additional pontoons, limiting barriers, stop log type gates, and small artificial islands, the additional pontoons being installed along the external perimeter of the banking ring, the partitions being installed in the form of beams diverging from the additional pontoons and coupled by canals with the internal bay for passing ships from said internal bay to an open sea; partition sides facing away from said pontoons are blocked by stop log type gates and coupled by means of the limiting barrier made of a chain of additional pontoons and banked with earth at the exterior; sectors limited by the external perimeter of the banking ring, by the partitions at each side, and by the limiting barrier at the exterior, forming water areas, and the small artificial island being made of an irregular form from the additional pontoons and hydraulically deposited earth and erected in said water areas.

18. The artificial island according to claim 14, characterized in that additional pontoons are made in hexagonal form.

19. The artificial island according to claim 14, characterized in that additional pontoons are made of ferroconcrete.

20. The artificial island according to claim 14, characterized in that the peripheral artificial island formations are intended for building a sea dendropark consisting of basin technological complexes for industrial reproduction of marine flora and fauna, and sports, tourist and recreation complexes.

21. An artificial island support comprising an outlining envelope installed onto the sea bottom and rising above sea level, and support piles, characterized in that the artificial island support is provided by buoyant floating piles, the outlining envelope is made so as to be capable of forming an internal bay from main pontoons disposed along a ring in the form of diverging beams, sides of those main pontoons facing the internal bay are coupled by means of a banking ring, the support piles are driven down along the internal perimeter of the banking ring to hard carrier rocks of the sea bottom, and the floating piles are driven down along the external perimeter of the banking ring and coupled with their corresponding main pontoons.

22. The support according to claim 21, characterized in that the outlining envelope is made with at least one navigable canal which is capable of being blocked from an open sea.

23. The support according to claim 22, characterized in that said support is provided with gates for blocking the navigable canals.

24. The support according to claim 23, characterized in that the gates for blocking the navigable canals are of the stop log type.

25. The support according to claim 21, characterized in that the main pontoons are made in rectangular form.

26. The support according to claim 21, characterized in that the main pontoons are made of ferroconcrete.

27. The support according to claim 21, characterized in that the main pontoons are made with internal compartments for filling them with an earth excavated during a sea bottom leveling.

28. The support according to claim 21, characterized in that the banking ring is made of earth hydraulically deposited concentrically from the internal border of said ring to its external border, the earth height exceeding the top level of the main pontoons.

29. The support according to claim 21, characterized in that the banking ring, excluding places intended for the navigable canals, is strengthened with large-fragmental rocks delivered from continental deposits.

30. The support according to claim 21, characterized in that the banking ring, excluding places intended for the navigable canals, is strengthened at the interior with a support wall made of ferroconcrete plates.

31. A method for building an artificial island on a sea shelf, said method including steps of installing an outlining envelope rising above sea level, and driving down supporting piles, characterized in the steps of leveling the sea bottom is performed, the outlining envelope being made yielding an internal bay by means of installing main pontoons disposed along a ring in the form of diverging beams, sides of said pontoons facing the internal bay being coupled by means of a banking ring, along which external perimeter opposite to the main pontoons buoyant floating piles are driven down and fixed to said pontoons, driving down supporting piles to hard carrier rocks of the sea bottom along the internal perimeter of the banking ring, excluding positions intended for navigable canals with the blocking ability, forming at least one navigable canal with a blocking ability for coupling the internal bay with the open sea is performed, and thereafter erecting a dome on the support piles above the internal bay is performed.

32. The method according to claim 31, characterized in that the main pontoons are made in a rectangular form.

33. The method according to claim 31, characterized in that the main pontoons are made of ferroconcrete.

34. The method according to claim 31, characterized in that the main pontoons are made with internal compartments, said main pontoons being transported by water to an installation place, and then sunk by filling their internal compartments with an earth excavated earlier during the step of leveling the sea bottom.

35. The method according to claim 31, characterized in that the banking ring is made by depositing hydraulically an earth concentrically from the internal border of said ring to its external border with a height exceeding the top level of the main pontoons.

36. The method according to claim 31, characterized in that the banking ring, excluding places intended for the navigable canals, is strengthened with large-fragmental rocks delivered from continental deposits.

37. The method according to claim 31, characterized in that the banking ring, excluding places intended for the navigable canals, is strengthened at the interior with a support wall made of ferroconcrete plates.

38. The method according to claim 31, characterized in that after the step of installing the outlining envelope, at least one peripheral artificial island formation is made at the exterior of said outlining envelope.

39. The method according to claim 38, characterized in that the peripheral artificial island formation is made in the form of additional pontoons installed in the form of separate beams diverging from the artificial island center, the peripheral artificial island formation being fixed in its node points to additional floating piles.

40. The method according to claim 38, characterized in that the peripheral artificial island formation is made in the form of additional pontoons, partitions with canals, limiting barrier, stop log type gates, and small artificial islands, the additional pontoons being installed along the external perimeter of the banking ring, the partitions being made of the main pontoons, installed in the form of beams diverging from the additional pontoons, and coupled by canals with the internal bay for passing ships from said internal bay to an open sea; partition sides facing away from said additional pontoons are blocked by stop log type gates and coupled by means of the limiting barrier made of a chain of additional pontoons and banked with earth at the exterior; sectors limited by the external perimeter of the banking ring, by the partitions at each side, and by the limiting barrier at the exterior, forming water areas, and the small artificial island being made in an irregular form from the additional pontoons and hydraulically deposited earth in those water areas.

41. The method according to claim 38, characterized in that additional pontoons are made in hexagonal form.

42. The method according to claim 38, characterized in that additional pontoons are made of ferroconcrete.

43. The method according to claim 38, characterized in that the peripheral artificial island formation is intended for building a sea dendropark consisting of basin technological complexes for industrial reproduction of marine flora and fauna, and sports, tourist and recreation complexes.

44. The method according to claim 38, characterized in that the dome above the internal bay is built for creating a grotto.

45. The method according to claim 38, characterized in that the dome is made in the form of a tower.

46. The method according to claim 45, characterized in that the tower is made stepped conical.

47. The method according to claim 45, characterized in that the tower is made cylindrical.

48. The method according to claim 45, characterized in that the tower is built with a technique of casting continuously the concrete.

49. The method according to claim 45, characterized in that the tower is built with a technique of arranging the large-sized prefabricated elements fixed to the structure carrier framework collected from carrier columns.

50. The method according to claim 45, characterized in that the upper part of the tower is made of glass.

51. The method according to claim 31, characterized in that after building the dome, the gate is installed in the navigable canal for blocking that canal.

52. The method according to claim 51, characterized in that the stop log type gate is employed for blocking the navigable canal.

53. The method according to claim 31, characterized in that after building the dome, a drilling equipment is installed in the internal bay on a floating support, said bay is blocked from an open sea, and at least one borehole is drilled.

54. The method according to claim 53, characterized in that the drilled boreholes are preserved, the drilling equipment is dismounted and removed from the internal bay along the navigable canal.

55. The method according to claim 31, characterized in that in the tower, levels are made in an internal grotto space, yielding three levels for placing equipment.

56. The method according to claim 55, characterized in that in the tower, an oil/gas producing equipment and reservoirs are mounted on the first level, an oil/gas refining equipment is mounted on the second level, and a power-generating unit is mounted on the third level, living rooms being placed along the tower side generating line on the second and third levels, and production areas being placed along the tower side generating line on the first level.

57. The method according to claim 55, characterized in that after mounting the equipment, a layout of the power network from the power-generating unit, and a layout of the water pipe-line and waste-water conduit are performed.

58. The method according to claim 31, characterized in that produced raw material and/or products of its refining are sent using corresponding ships via the navigable canals.

59. The method according to claim 31, characterized in that the artificial island is made according to a type of landscape of a mountain volcanic island covered with vegetation.

* * * * *